United States Patent [19]

Byers

[11] Patent Number: 4,705,521

[45] Date of Patent: Nov. 10, 1987

[54] PROCESS FOR REHEATING DYE-RECEIVING ELEMENT CONTAINING STABILIZER

[75] Inventor: Gary W. Byers, Webster, N.Y.

[73] Assignee: Eastman Kodak Company, Rochester, N.Y.

[21] Appl. No.: 899,273

[22] Filed: Aug. 22, 1986

[51] Int. Cl.[4] ..... B41M 5/26

[52] U.S. Cl. ..... 8/471; 427/146; 427/256; 427/372.2; 427/384; 427/385.5; 428/195; 428/913; 428/914; 430/945

[58] Field of Search ..... 428/195, 913, 914, 411.1; 430/945; 8/470, 471; 427/146, 256, 372.2, 384, 385.5, 428

[56] References Cited

FOREIGN PATENT DOCUMENTS

| | | | |
|---|---|---|---|
| 97493 | 1/1984 | European Pat. Off. | 8/471 |
| 147747 | 7/1985 | European Pat. Off. | 8/471 |
| 59-182785 | 10/1984 | Japan | 8/471 |
| 0224844 | 12/1984 | Japan | 428/914 |
| 60-125697 | 7/1985 | Japan | 8/471 |

OTHER PUBLICATIONS

U.S. appln. Ser. No. 879,690—Vanier et al., filed 6/27/86.

U.S. appln. Ser. No. 899,274—Byers, filed 8/22/86.

*Primary Examiner*—Bruce H. Hess

*Attorney, Agent, or Firm*—Harold E. Cole

[57] ABSTRACT

A process is described for reheating a dye image-receiving element containing a thermally-transferred dye image and a stabilizer. Stratification of the transferred dye image in the receiving element is thereby reduced, resulting in an increase in stability to light of the transferred dyes.

9 Claims, No Drawings

PROCESS FOR REHEATING DYE-RECEIVING ELEMENT CONTAINING STABILIZER

This invention relates to a process for reheating a dye image-receiving element containing a thermally-transferred dye image and a stabilizer which provides an increased stability to light.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

The thermal transfer system described above utilizes differentially applied heating power for image discrimination. This means that low density image areas are heated less than high density areas in order to transfer less dye from the dye-donor element to the dye-receiving element. Since the time of heating is very short (generally less than 5 msec), thermal equilibrium is usually not attained. Thus a thermal gradient exists, the lower depths of the dye-receiving layer being less heated than near the exterior surface. These inherent factors of thermal dye transfer printing can lead to various problems.

. One problem that has developed with the above-described thermal transfer system is that dye stratifies at the exterior surface of the dye-receiving layer. This is especially evident in lower density areas where the dye appears to be primarily near the surface of the dye-receiving layer. This dye stratification accentuates light stability problems and the possibility of "retransferring" the dye to another undesired surface. Extreme stratification can also lead to changes in the covering power of the dye and may even give the dye an undesirable appearance of a metallic, golden sheen.

Japanese patent publication No. J60/125697, European patent application No. 97,493 and U.S. application Ser. No. 879,690, of Vanier et al, filed June 27, 1986 describe various methods for reheating thermally-transferred dye images. While these methods have been found useful in increasing the light stability of transferred dyes, it would be desirable to improve their effectiveness.

Japanese patent publication No. J59/182785, European patent application No. 147,747 and U.S. application Ser. 899,274, of Byers entitled "Alkoxy Derivative Stabilizers For Dye-Receiving Element Used in Thermal Dye Transfer", filed Aug. 22, 1986, describe various stabilizers, including a variety of multialkoxy derivatives, useful in thermal dye transfer systems. While these stabilizers have been found useful for their intended purpose, it would be desirable to find a way to increase their effectiveness.

In accordance with this invention, a process of forming a stable dye transfer image is provided which comprises:

(a) imagewise-heating a dye-donor element comprising a support having thereon a dye layer, (b) transferring a dye image to a dye-receiving element to form a dye transfer image, the dye-receiving element comprising a support having thereon a dye image-receiving layer containing a stabilizer compound, and (c) heating the dye-receiving element containing the transferred dye image, so that stratification of the transferred dye image in the dye-receiving element is reduced.

By use of the invention, a synergistic effect is obtained which is greater than the effect which can be obtained by using the reheating technique alone or by using a stabilizer alone. This effect will be demonstrated by the examples hereinafter. Reheating of a dye-receiving element which contains a stabilizer not only drives the transferred dye from the surface of the dye image-receiving layer deeper into the layer but also promotes more intimate and effective contact of the dye with the stabilizer.

Any reheating technique or device can be employed in the invention as long as it will provide useful results. There can be employed, for example, a separate heating device as disclosed in Japanese patent publication No. J60/125697, a pair of heated rollers as disclosed in European patent application No. 97,493, or use of the thermal head itself as described in U.S. patent application Ser. No. 879,690, of Vanier et al al filed June 27, 1986, the disclosures of which are hereby incorporated by reference.

Any stabilizer can be employed in the invention which is useful for the intended purpose. There can be employed, for example, those materials disclosed in Japanese patent publication No. J59/182785, European patent application No. 147,147 and U.S. application Ser. No. 899,274, of Byers entitled "Alkoxy Derivative Stabilizers For Dye-Receiving Element Used in Thermal Dye Transfer", filed Aug. 22, 1986, the disclosures of which are hereby incorporated by reference.

In a preferred embodiment of the invention, the stabilizer which is employed has the following moiety:

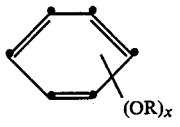

wherein each R independently is an alkyl or substituted alkyl group of from 1 to about 20 carbon atoms, or two adjacent R groups may be joined together to form methylene or ethylene; and x is at least 2.

In another preferred embodiment, R in the above formula is an alkyl group of from 1 to about 10 carbon atoms and x is 4.

In still another preferred embodiment of the invention, the stabilizer which is employed has the following moiety:

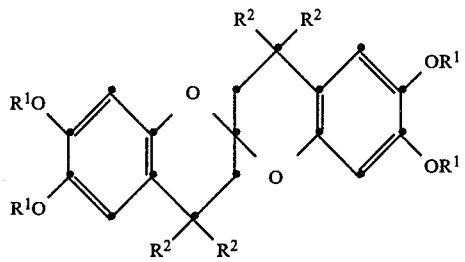

wherein each $R^1$ and $R^2$ is independently an alkyl or substituted alkyl group of from 1 to about 20 carbon atoms, or two adjacent $R^1$ groups may be joined together to form methylene or ethylene.

In yet another preferred embodiment, each $R^1$ and $R^2$ in the above formula is independently an alkyl group of from 1 to about 4 carbon atoms.

The stabilizer may be present at any concentration which is effective for the intended purpose. In general, good results have been obtained when the stabilizer is present at a concentration of from about 5 to about 20% by weight of the dye image-receiving layer.

Specific stabilizers useful in the invention include the following:

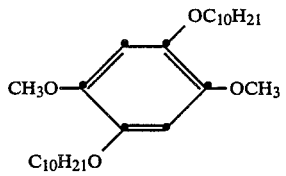

(1)

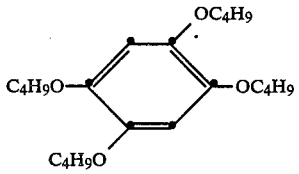

(2)

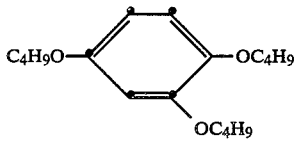

(3)

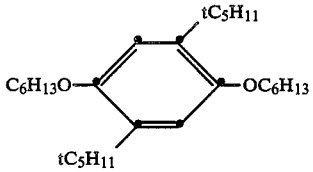

(4)

-continued

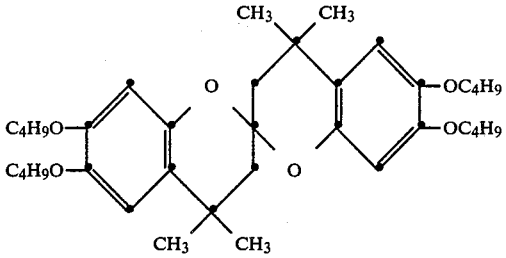

(5)

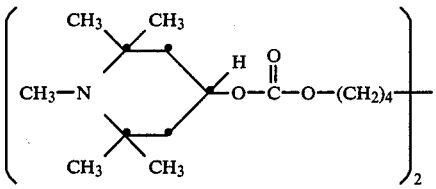

(6)

Tinuvin 292 ® Ciba Geigy

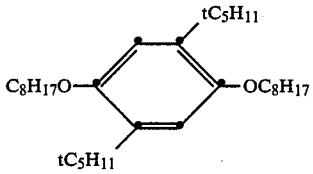

(7)

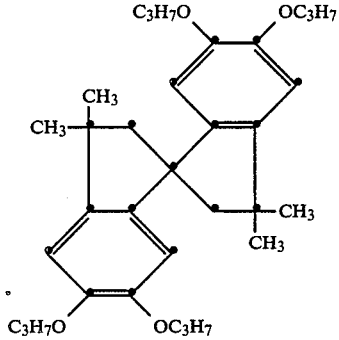

(8)

The support for the dye-receiving element employed in the invention may be a transparent film such as a poly(ether sulfone), a polyimide, a cellulose ester such as cellulose acetate, a poly(vinyl alcohol-co-acetate) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone), or mixtures thereof. The dye image-receiving layer may be present in any amount which is effective for the intended purpose. In general, good results have been obtained at a coverage of from about 1 to about 10 g/m$^2$ of dye image-receiving layer.

A dye-donor element that is used with the dye-receiving element employed in the process of the invention comprises a support having thereon a dye layer. Any dye can be used in such a layer provided it is transferable to the dye image-receiving layer of the dye-receiving element of the invention by the action of heat.

Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co., Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

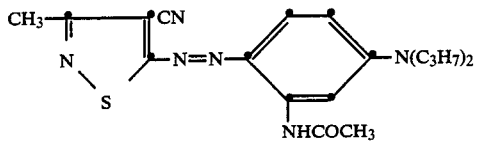

(magenta)

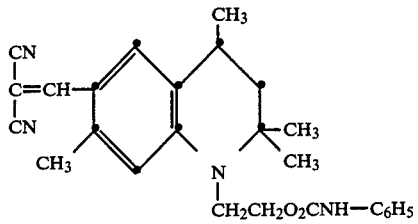

(yellow)

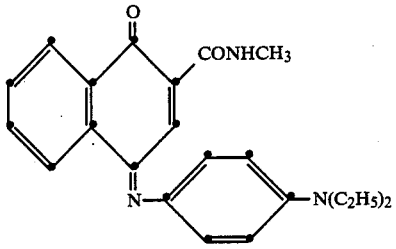

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidiene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-donor element employed in certain embodiments of the invention may be used in sheet form or in a continuous roll or ribbon. If a continuous roll or ribbon is employed, it may have only one dye thereon or may have alternating areas of different dyes, such as cyan, magenta, yellow, black, etc., as disclosed in U.S. Pat. No. 4,451,830.

In a preferred embodiment of the invention, a dye-donor element is employed which comprises a poly(ethylene terephthalate) support coated with sequential repeating areas of cyan, magenta and yellow dye, and the process steps described above are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1080 or a Rohm Thermal Head KE 2008-F3.

To obtain a three-color transfer image, after the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Black Dye (A) A neutral or black dye-donor element was prepared by coating the following layers in the order recited on a 6 μm poly(ethylene terephthalate) support:

(1) Dye-barrier layer of polyacrylic acid coated from a methanol and water solvent mixture (0.17 g/m$^2$), (2) Dye layer containing the following "black" dye (0.38 g/m$^2$) in cellulose acetate butyrate (28% acetyl, 17% butyryl) (0.32 g/m$^2$) coated from a 2-butanone and acetone solvent mixture:

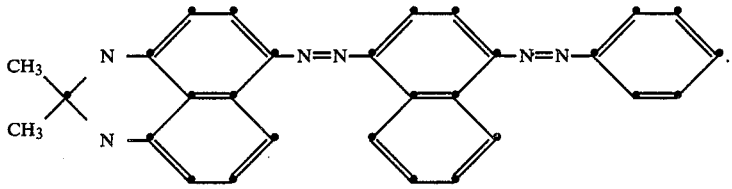

Sudan Black B

A slipping layer was coated on the back side of the dye-donor element which consisted of poly(vinyl stearate) (0.34 g/m$^2$) in poly(vinylbutyryl) (0.52 g/m$^2$) coated from a tetrahydrofuran mixture.

(B) A "black" donor element was prepared similar to (A), except that no dye layer was coated on top of the barrier layer.

Dye-receiving elements were prepared by coating a solution of Bayer AG Makrolon 5705 ® Polycarbonate (2.9 g/m$^2$) and the amount of stabilizer compound identified above indicated in Table 1, equivalent to 0.54 mmoles/m$^2$, from a methylene chloride and trichloroethylene solvent mixture on top of an ICI Melinex ® 990 "White Polyester" reflective support.

A control dye-receiving element was prepared as above except that it had 2.9 g/m$^2$ of polycarbonate resin only.

The dye side of each dye-donor element was placed in contact with the dye image-receiving layer of the dye-receiver element one inch wide. The assemblage was fastened in the jaws of a stepper motor driven pulling device. The assemblage was laid on top of a 0.55 in. (14 mm) diameter rubber roller and a TDK Thermal Head (No. L-133) and was pressed with a spring at a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated at increments from 0 to 8.3 msec to generate a graduated density test pattern. The voltage supplied to the print head was approximately 22 v representing approximately 1.5 watts/dot (12 mjoules/dot) for maximum power.

The dye-receiver was then separated from each of the dye donors and the Status A red reflection density of each stepped image was read. The dye-receiver was then each placed in contact with the barrier layer side of the "blank" donor element. Uniform reheating of the entire stepped image on the receiver at the full-power setting (i.e., that used originally to provide maximum dye density) was performed in the manner as described above. Each image was then subjected to fading for 4 days, 5.4 kLux, 5400° K., 32° C., approximately 25% RH. The density was re-read and the percent density losses at selected steps were calculated. The following results were obtained:

TABLE 1

| | | (Status A Red) | | | |
|---|---|---|---|---|---|
| | | Step 8 | | Step 5 | |
| Stabilizer (g/m$^2$) | Reheating | Init. Dens. | % Loss After Fade | Init. Dens. | % Loss After Fade |
| none | No | 2.3 | 25 | 0.9 | 46 |
| (control) | Yes | 2.2 | 20 | 0.9 | 32 |
| Compound 1 | No | 2.6 | 14 | 1.1 | 34 |
| (0.24) | Yes | 2.5 | 13 | 1.1 | 15 |
| Compound 2 | No | 2.5 | 21 | 1.1 | 37 |
| (0.20) | Yes | 2.5 | 14 | 1.1 | 18 |
| Compound 3 | No | 2.6 | 22 | 1.1 | 37 |
| (0.16) | Yes | 2.5 | 13 | 1.1 | 20 |
| Compound 4 | No | 2.4 | 23 | 1.1 | 39 |
| (0.23) | Yes | 2.5 | 14 | 1.0 | 20 |
| Compound 5 | No | 2.5 | 17 | 1.1 | 38 |
| (0.32) | Yes | 2.4 | 14 | 1.0 | 18 |

The results indicate that reheating of a receiver which contains a stabilizer in accordance with the invention provides a substantial improvement in dye stability beyond that obtained by reheating of a receiver which did not contain a stabilizer, or by just using a receiver containing a stabilizer but no reheating.

EXAMPLE 2

Yellow Dye (A) A yellow dye-donor element was prepared by coating the following layers in the order recited on a 6 μm poly(ethylene terephthalate) support:

(1) Dye-barrier layer of gelatin nitrate (gelatin, cellulose nitrate and salicylic acid in approximately 20:5:2 weight ratio in a solvent of acetone, methanol and water) (0.11 g/m$^2$), and (2) Dye layers containing the following yellow dye (0.19 g/m$^2$), poly(tetrafluoroethylene) micropowder (16 mg/m$^2$) and cellulose acetate propionate (2.5% acetyl, 45% propionyl) (0.41 g/m$^2$) coated from a 2-butanone and cyclopentanone solvent mixture:

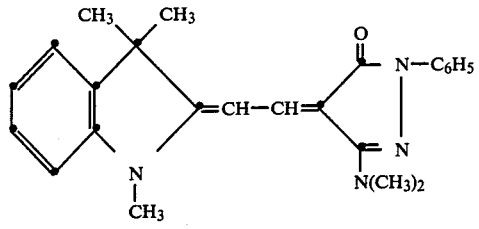

This compound is the subject of patent application Ser. No. 915,451 of Evans et al. filed Oct. 6, 1986.

A slipping layer was coated on the back side of the dye-donor element similar to that disclosed in U.S. application Ser. No. 813,199 of Vanier et al, filed Dec. 24, 1985.

(B) A "blank" donor element was prepared similar to (A), except that no dye layer was coated on top of the barrier layer.

Dye-receiving elements were prepared as in Example 1.

Processing was performed as in Example 1 except that the dye fade conditions were for 7 days at 50 kLux. The following results were obtained:

TABLE 2

| | | (Status A Blue) | | | |
|---|---|---|---|---|---|
| | | Step 8 | | Step 5 | |
| Stabilizer ($g/m^2$) | Reheating | Init. Dens. | % Loss After Fade | Init. Dens. | % Loss After Fade |
| none | No | 1.8 | 18 | 0.8 | 50 |
| (control) | Yes | 1.6 | 12 | 0.7 | 18 |
| Compound 1 | No | 2.1 | 9 | 1.1 | 26 |
| (0.24) | Yes | 1.9 | 5 | 1.0 | 5 |
| Compound 2 | No | 2.0 | 11 | 1.0 | 29 |
| (0.20) | Yes | 1.9 | 5 | 0.9 | 8 |
| Compound 3 | No | 2.0 | 11 | 1.0 | 33 |
| (0.16) | Yes | 2.0 | 6 | 0.9 | 7 |
| Compound 4 | No | 2.0 | 11 | 1.0 | 29 |
| (0.23) | Yes | 1.9 | 5 | 0.9 | 8 |
| Compound 5 | No | 2.0 | 12 | 1.0 | 32 |
| (0.32) | Yes | 1.9 | 6 | 0.9 | 07 |

The results indicate that reheating of a dye-receiver containing a stabilizer in accordance with the invention provides a synergistic effect when a yellow dye is used.

EXAMPLE 3

Magenta Dye (A) A magenta dye-donor element was prepared similar to Example 2 except that the dye was the following ($0.17\ g/m^2$):

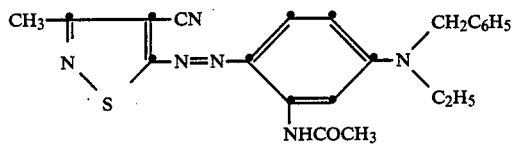

(B) A "blank" donor element was prepared similar to (A), except that no dye layer was coated on top of the barrier layer.

Dye-receiving elements were prepared as in Example 1.

Processing was performed as in Example 2. The following results were obtained:

TABLE 3

| | | (Status A Green) | | | |
|---|---|---|---|---|---|
| | | Step 8 | | Step 5 | |
| Stabilizer ($g/m^2$) | Reheating | Init. Dens. | % Loss After Fade | Init. Dens. | % Loss After Fade |
| none | No | 1.9 | 23 | 0.9 | 55 |
| (control) | Yes | 2.1 | 05 | 1.0 | 5 |
| Compound 1 | No | 2.3 | 17 | 1.1 | 36 |
| (0.24) | Yes | 2.4 | 4 | 1.2 | 4 |
| Compound 2 | No | 2.1 | 21 | 1.0 | 41 |
| (0.20) | Yes | 2.4 | 5 | 1.2 | 4 |
| Compound 3 | No | 2.1 | 13 | 1.0 | 36 |
| (0.16) | Yes | 2.4 | 4 | 1.1 | 3 |
| Compound 4 | No | 2.0 | 14 | 1.0 | 36 |
| (0.23) | Yes | 2.4 | 3 | 1.2 | 2 |
| Compound 5 | No | 1.9 | 14 | 0.9 | 37 |
| (0.32) | Yes | 2.3 | 3 | 1.1 | 3 |

The above results again indicate that reheating of a dye-receiver containing a stabilizer in accordance with the invention provides a synergistic effect when a magenta dye is used.

The invention has been described in detail with particular reference to preferred embodiments thereof, but it will be understood that variations and modifications can be effected within the spirit and scope of the invention.

What is claimed is:

1. A process of forming a stable dye transfer image comprising:

(a) imagewise-heating a dye-donor element comprising a support having thereon a dye layer, (b) transferring a dye image to a dye-receiving element to form a dye transfer image, said dye-receiving element comprising a support having thereon a dye image-receiving layer containing a stabilizer compound to increase the stability to light of said transferred dye image, and (c) heating said dye-receiving element containing said transferred dye image, so that stratification of said transferred dye image in said dye-receiving element is reduced, thereby further increasing the stability to light of said transferred dye image.

2. The process of claim 1 wherein said heating of said dye-receiving element is accomplished by using a thermal print head.

3. The process of claim 1 wherein said heating of said dye-receiving element is accomplished by using a separate heating device.

4. The process of claim 3 wherein said heating device is a heated roller.

5. The process of claim 1 wherein said stabilizer compound has the following moiety:

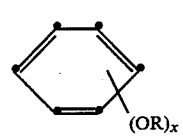

wherein each R independently is an alkyl or substituted alkyl group of from 1 to about 20 carbon atoms, or two adjacent R groups may be joined together to form methylene or ethylene; and x is at least 2.

6. The process of claim 5 wherein each R independently is an alkyl group of from 1 to about 10 carbon atoms and x is 4.

7. The process of claim 1 wherein said stabilizer compound has the following moiety:

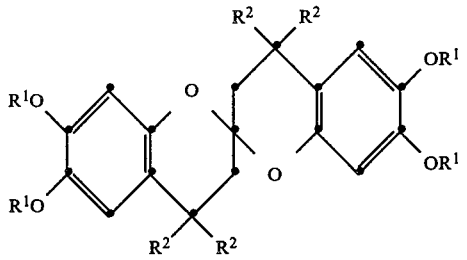

wherein each $R^1$ and $R^2$ is independently an alkyl or substituted alkyl group of from 1 to about 20 carbon atoms, or two adjacent $R^1$ groups may be joined together to form methylene or ethylene.

8. The process of claim 7 wherein each $R^1$ and $R^2$ independently is an alkyl group of from 1 to about 6 carbon atoms.

9. The process of claim 1 wherein the support for the dye-donor element comprises poly(ethylene terephthalate), which is coated with sequential repeating areas of cyan, magenta and yellow dye, and said process steps are sequentially performed for each color to obtain a three-color dye transfer image.

* * * * *